US011091313B2

(12) United States Patent
Pichot et al.

(10) Patent No.: US 11,091,313 B2
(45) Date of Patent: Aug. 17, 2021

(54) ROTATABLE DISPENSER ASSEMBLY FOR SOLID UNITS

(71) Applicant: CSP TECHNOLOGIES, INC., Auburn, AL (US)

(72) Inventors: Herve Pichot, Chennevieres-sur-Marne (FR); Jean-Pierre Giraud, Auburn, AL (US)

(73) Assignee: CSP Technologies, Inc., Auburn, AL (US)

( * ) Notice: Subject to any disclaimer, the term of this patent is extended or adjusted under 35 U.S.C. 154(b) by 113 days.

(21) Appl. No.: 16/304,254

(22) PCT Filed: May 23, 2017

(86) PCT No.: PCT/US2017/033912
§ 371 (c)(1),
(2) Date: Nov. 23, 2018

(87) PCT Pub. No.: WO2017/205316
PCT Pub. Date: Nov. 30, 2017

(65) Prior Publication Data

US 2019/0218016 A1 Jul. 18, 2019

Related U.S. Application Data

(60) Provisional application No. 62/340,413, filed on May 23, 2016.

(51) Int. Cl.
*B65D 83/04* (2006.01)
*B65H 1/08* (2006.01)

(52) U.S. Cl.
CPC ..... *B65D 83/0418* (2013.01); *B65H 1/08* (2013.01)

(58) Field of Classification Search
CPC ..... B65H 1/08; B65H 83/04; B65H 85/62; B65H 3/24; G07F 11/16; B65D 83/0418
(Continued)

(56) References Cited

U.S. PATENT DOCUMENTS 2,526,615 A * 10/1950 Bedaux ..... B65D 83/0418 221/260
3,270,915 A * 9/1966 Auer ..... B65D 83/0418 221/2
(Continued)

FOREIGN PATENT DOCUMENTS

CN 101119903 A1 2/2008
DE 102011009073 A1 7/2012
(Continued)

OTHER PUBLICATIONS

International Search Report for PCT/US2017/033912, dated Sep. 19, 2017.

*Primary Examiner* — Rakesh Kumar
(74) *Attorney, Agent, or Firm* — Mark T. Vogelbacker; Eckert Seamans Cherin & Mellott, LLC

(57) ABSTRACT

A dispenser assembly (2) for solid units (4) includes an outer sleeve (10) having an end (12) and a first sidewall (14) extending from the end of the outer sleeve, the first sidewall having a window (19) proximate to the end of the outer sleeve; and an inner) housing (50) inserted into the outer sleeve, the inner housing including an end (54) with an opening therein leading to a compartment configured for storing the solid units. The dispenser assembly (2) is configured to rotate between a CLOSED position corresponding to the window being blocked by a portion of the inner housing, and an OPEN position corresponding to the window not being blocked by the inner housing in order to allow at least one of the solid units to be dispensed through the window.

17 Claims, 13 Drawing Sheets

(58) Field of Classification Search
USPC ..... 221/272
See application file for complete search history.

(56) References Cited

U.S. PATENT DOCUMENTS

| | | | | | |
|---|---|---|---|---|---|
| 3,762,539 | A * | 10/1973 | Kerr | B65D 83/0481 | 206/537 |
| 4,489,853 | A * | 12/1984 | Korte | A61J 7/0076 | 221/187 |
| 5,178,298 | A * | 1/1993 | Allina | B65D 83/0418 | 206/457 |
| 5,489,024 | A * | 2/1996 | Bunin | B65D 50/046 | 206/528 |
| 5,566,857 | A * | 10/1996 | Rothman | B65D 83/0418 | 221/229 |
| D375,679 | S * | 11/1996 | Russell | D20/7 | |
| 5,785,206 | A * | 7/1998 | Chan | G07F 11/14 | 221/198 |
| 6,564,967 | B1 * | 5/2003 | Stringfield | B65D 83/0418 | 221/229 |
| 6,889,869 | B2 * | 5/2005 | Hallin | B65D 83/0418 | 221/223 |
| 6,918,509 | B2 * | 7/2005 | Baker | A47F 1/10 | 221/263 |
| 7,118,550 | B2 * | 10/2006 | Loomis | A61F 13/26 | 604/60 |
| 7,204,391 | B2 * | 4/2007 | Toker | A61J 7/0076 | 221/208 |
| 7,523,841 | B2 * | 4/2009 | Konig | B65D 83/0418 | 221/197 |
| 7,708,061 | B2 * | 5/2010 | McGuire | E21B 33/126 | 166/202 |
| D691,365 | S * | 10/2013 | Cote | D3/203.2 | |
| 9,248,949 | B2 * | 2/2016 | Leifeld | B65D 83/0418 | |
| 9,764,888 | B2 * | 9/2017 | Tiesberger | B65D 83/0409 | |
| 9,932,166 | B2 * | 4/2018 | Marqua | B65D 83/0418 | |
| 10,569,286 | B2 * | 2/2020 | Anderson | B65D 83/0445 | |
| 2006/0049079 | A1 * | 3/2006 | Brenner | B65D 83/049 | 206/536 |
| 2006/0118435 | A1 * | 6/2006 | Cronin | B65D 51/2892 | 206/219 |
| 2007/0125794 | A1 * | 6/2007 | Jones | G07F 11/14 | 221/231 |
| 2009/0212078 | A1 * | 8/2009 | Gaus | B65D 47/2031 | 222/490 |
| 2010/0294791 | A1 * | 11/2010 | Weibel | B65D 83/0409 | 221/1 |
| 2012/0275142 | A1 * | 11/2012 | Lundy | F21L 4/027 | 362/184 |
| 2013/0292403 | A1 * | 11/2013 | Cote | B65D 21/0204 | 221/92 |
| 2017/0043939 | A1 * | 2/2017 | Marqua | A61J 1/03 | |
| 2018/0353386 | A1 * | 12/2018 | Sita | A61J 7/04 | |
| 2019/0218016 | A1 * | 7/2019 | Pichot | B65D 83/0418 | |

FOREIGN PATENT DOCUMENTS

| | | | | |
|---|---|---|---|---|
| EP | 0052457 | A1 | 5/1982 | |
| JP | 2005104582 | A | 4/2005 | |
| JP | 2010235194 | A | 10/2010 | |
| WO | 9621596 | A2 | 7/1996 | |
| WO | WO-9621596 | A2 * | 7/1996 | B65D 83/0418 |

* cited by examiner

ROTATABLE DISPENSER ASSEMBLY FOR SOLID UNITS

CROSS-REFERENCE TO RELATED APPLICATIONS

This application is a U.S. National Phase of International Application No. PCT/US2017/033912 filed May 23, 2017, which claims priority to U.S. Provisional Patent Application No. 62/340,413 filed May 23, 2016, which are incorporated herein by reference in their entirety.

FIELD OF THE DISCLOSED CONCEPT

The disclosed concept relates to dispenser assemblies for solid units, e.g., tablets. More particularly, the disclosed concept relates to simple, two-piece moisture tight designs for rotatably actuated tablet dispensers.

BACKGROUND

Tablet dispensers are typically employed in the nutritional and candy industries in order to retain and dispense tablets. These dispensers may be designed for specific tablets, such as the PEZ brand dispenser for PEZ candy. Such conventional tablet dispensers require multiple components, which can add to the cost and complexity of manufacturing, assembly and filling. For example, conventional dispensers often require springs and separate interacting components, etc., to function. The multiple components and the operation of conventional tablet dispensers typically render them unfit to maintain moisture tightness. Conventional tablet dispensers are therefore unfit for housing and dispensing moisture sensitive products, such as solid pharmaceutical, nutriceutical or biological dosage units. Accordingly, there is a need for a simple tablet dispenser design. There is also a need for a simple tablet dispenser design that provides moisture tightness to the contents of the dispenser.

SUMMARY OF THE DISCLOSED CONCEPT

As one optional aspect of the disclosed concept, a dispenser assembly is provided for solid units. The dispenser assembly includes an outer sleeve having an end, a first sidewall extending from the end of the outer sleeve, and a second sidewall extending from the end of the outer sleeve. The first sidewall has a window proximate to the end of the outer sleeve. The second sidewall is located inboard of the first sidewall. The dispenser assembly further includes an inner housing inserted into the outer sleeve. The inner housing has an end with an opening therein leading to a compartment configured for storing the solid units. The inner housing further has a housing sealing surface. The dispenser assembly is configured to rotate between a SEALED position corresponding to the second sidewall forming a moisture tight seal with the housing sealing surface, and a DISPENSING position corresponding to the second sidewall being disengaged with the housing sealing surface in order to allow at least one of the solid units to be dispensed through the window.

As another optional aspect of the disclosed concept, a dispenser assembly is provided for solid units. The dispenser assembly consists of only the following two components: an outer sleeve and an inner housing. The outer sleeve includes an end, a first sidewall extending from the end of the outer sleeve, and a sleeve sealing surface located at or proximate to the end of the outer sleeve. The first sidewall has a window proximate to the end of the outer sleeve. The inner housing is inserted into the outer sleeve and includes an end with an opening therein leading to a compartment configured for storing the solid units, the inner housing further having a housing sealing surface. The dispenser assembly is configured to rotate between a SEALED position corresponding to the sleeve sealing surface forming a moisture tight seal with the housing sealing surface, and a DISPENSING position corresponding to the sleeve sealing surface being disengaged with the housing sealing surface in order to allow at least one of the solid units to be dispensed through the window.

As another optional aspect of the disclosed concept, a dispenser assembly is provided for solid units. The dispenser assembly includes an outer sleeve having an end and a first sidewall extending from the end of the outer sleeve, the first sidewall having a window proximate to the end of the outer sleeve; and an inner housing inserted into the outer sleeve, the inner housing including an end with an opening therein leading to a compartment configured for storing the solid units. The dispenser assembly is configured to rotate between a CLOSED position corresponding to the window being blocked by a portion of the inner housing, and an OPEN position corresponding to the window not being blocked by the inner housing in order to allow at least one of the solid units to be dispensed through the window.

BRIEF DESCRIPTION OF THE DRAWINGS

Exemplary embodiments of the present disclosed concept are shown in the enclosed drawings as follows.

DETAILED DESCRIPTION OF THE PREFERRED EMBODIMENTS

As employed herein, the term "component" shall mean a single unitary piece or element that does not require separate assembly steps. For example and without limitation, a molded piece is a "component." Additionally, a piece that is manufactured by overmolding or co-molding one element onto another element is a "component." Additionally, a piece or element that includes a body and an O-ring applied thereto through a multi-shot injection molding process or overmolding is a "component." However, a piece that comprises several elements that must be separately assembled together is not a "component."

As employed herein, the statement that two or more parts or components "engage" one another shall mean that the parts exert a force against one another either directly or through one or more intermediate parts or components.

As employed herein, the term "number" shall mean one or an integer greater than one.

Figure 1:
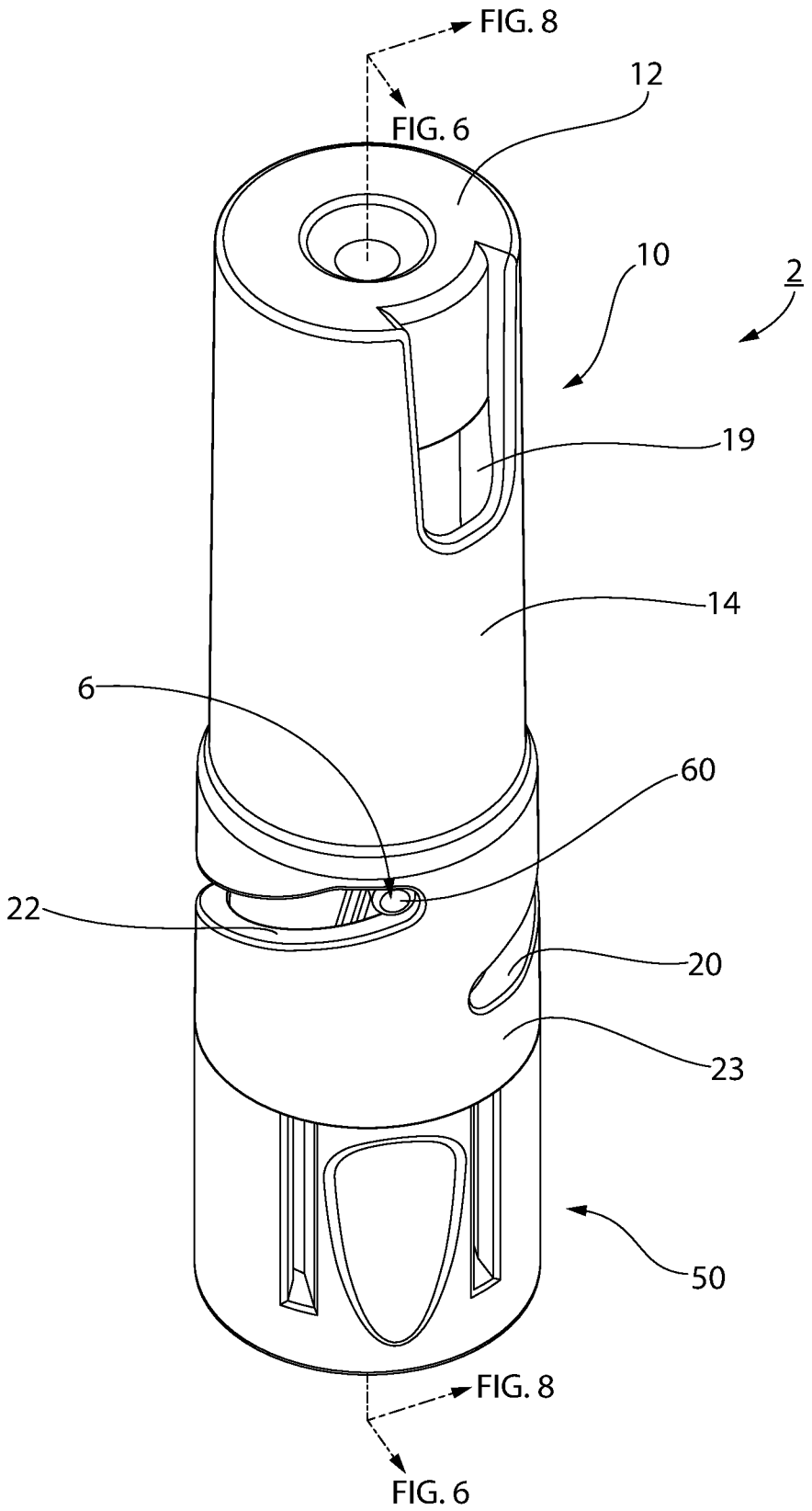
FIG. 1 is an isometric view of a dispenser assembly, shown in a first position, in accordance with one non-limiting embodiment of the disclosed concept.
Figure 2:
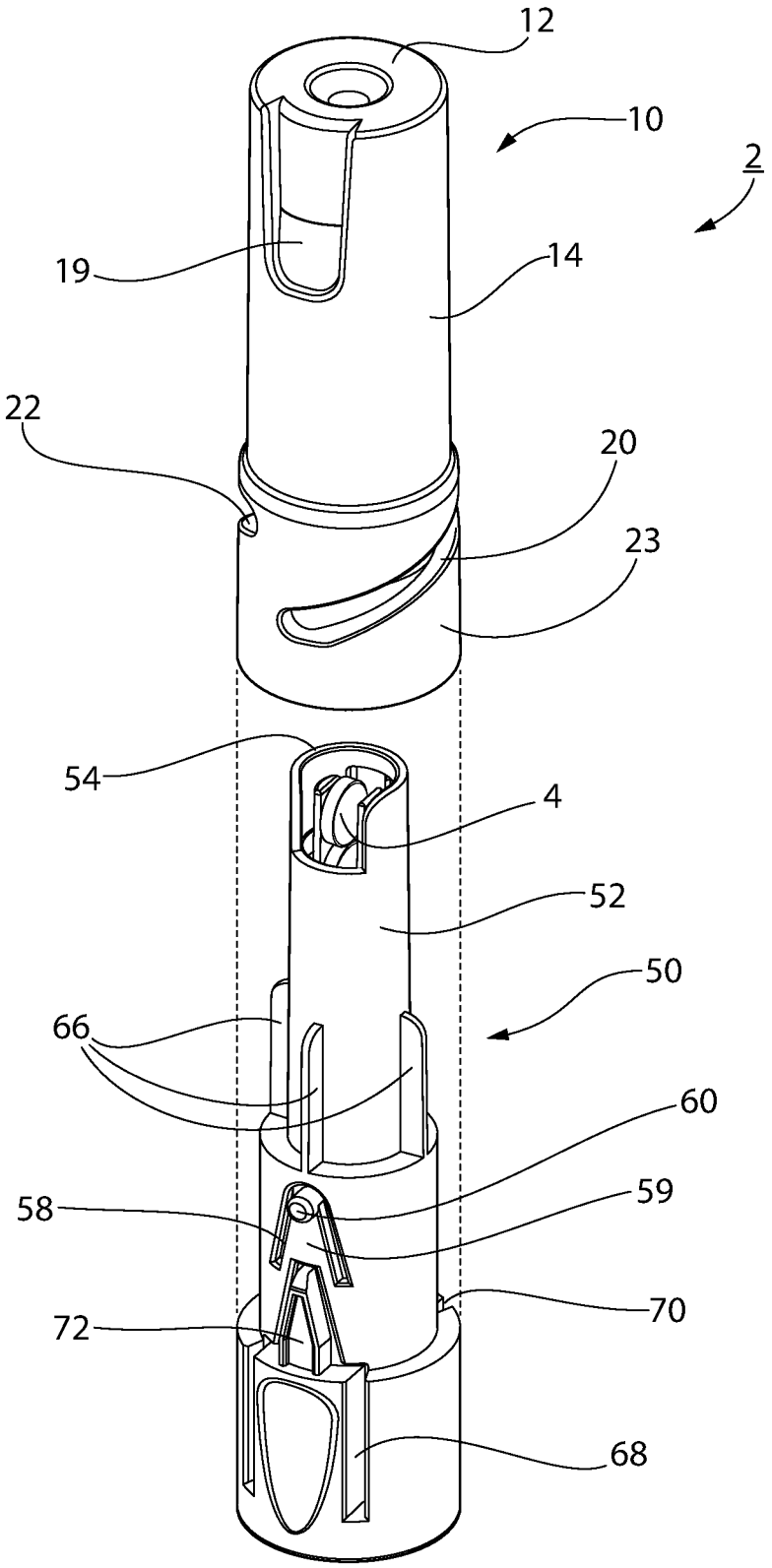
FIG. 2 is an exploded isometric view of the dispenser assembly of FIG. 1, showing a number of solid units located in an inner housing of the dispenser assembly.

FIG. 1 and FIG. 2 are isometric and exploded isometric views, respectively, of a dispenser assembly 2, in accordance with one non-limiting embodiment of the disclosed concept. Dispenser assembly 2 is for storing and dispensing a number of solid units 4, such as, for example and without limitation, solid pharmaceutical, nutriceutical or biological dosage units. Dispenser assembly 2 includes two components, namely an outer sleeve 10 and an inner housing 50 inserted into outer sleeve 10. In one exemplary embodiment, dispenser assembly 2 consists of only outer sleeve 10 and inner housing 50—no other components. Accordingly, it will be appreciated that manufacture, assembly and filling of dispenser 2 are relatively simple. For example, rather than having to manufacture and assemble three or more components, dispenser assembly 2 can be assembled by simply inserting and securing inner housing 50 in outer sleeve 10. Additionally, as will be discussed below, the simple manufacture/assembly of dispenser assembly 2 further provides advantages in terms of moisture tightness for solid units 4.

Figure 3:
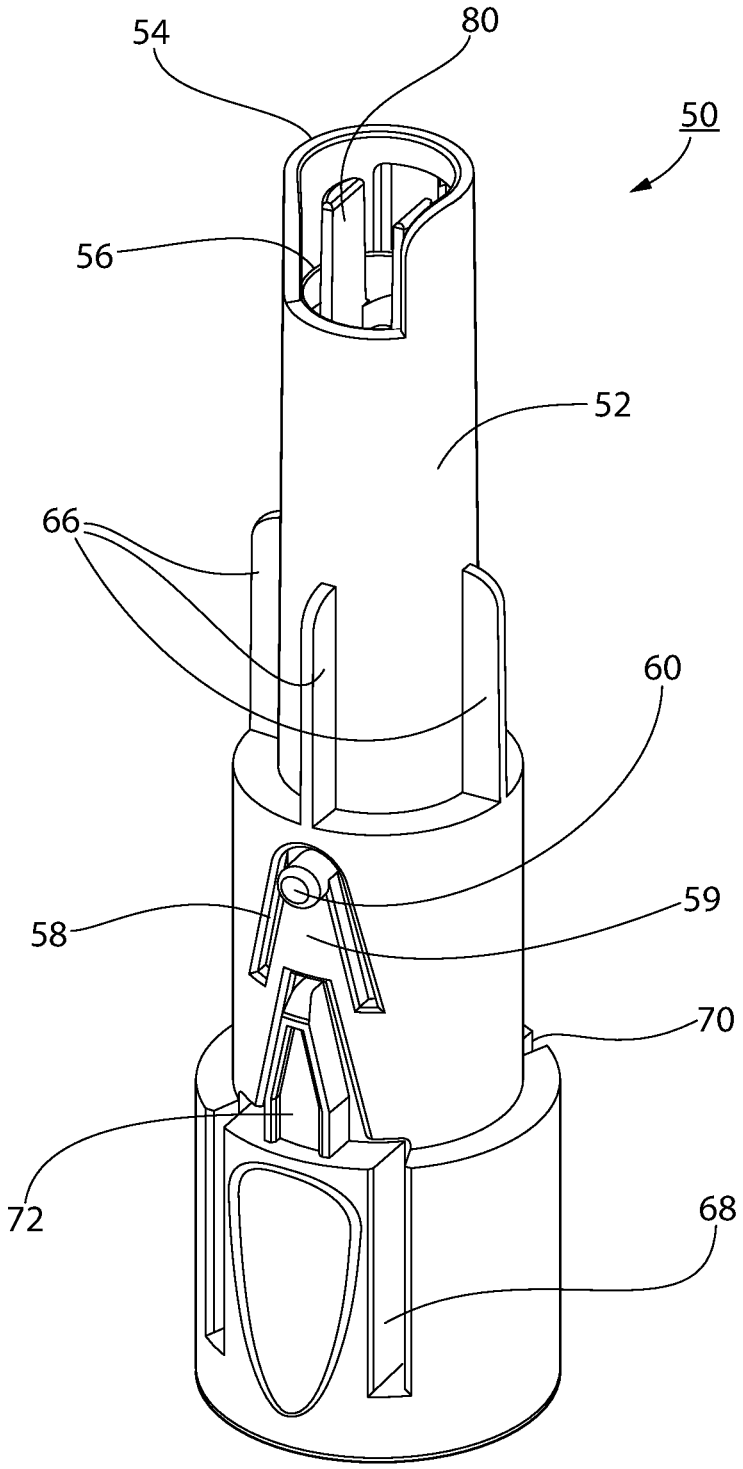
FIG. 3 and FIG. 4 are different isometric views of the inner housing of FIG. 2.
Figure 4:
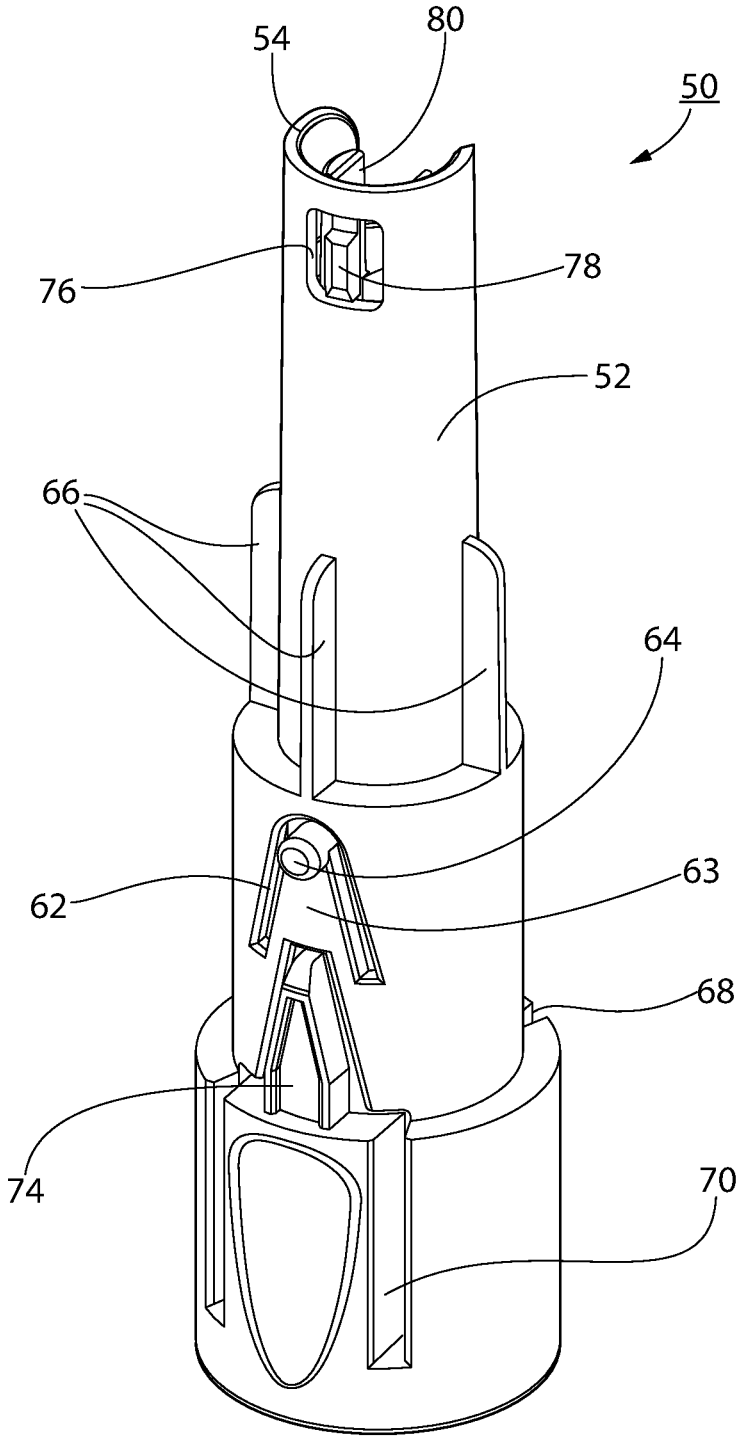

FIGS. 3 and 4 show different views of inner housing 50. As shown, inner housing 50 includes a body portion 52 having an end 54. End 54 has an opening leading to a compartment for storing solid units 4 (FIG. 2). Body portion 52 further has a number of slots (two example slots 58,62 are shown in FIGS. 3 and 4) each defining a corresponding deflectable tab 59,63. Furthermore, inner housing 50 has a number of button portions (two example button portions 60,64 are shown in FIGS. 3 and 4) each extending outwardly from a corresponding one of tabs 59,63. In one example embodiment, slot 58, tab 59, and button portion 60 are located opposite and distal corresponding slot 62, tab 63, and button portion 64. Continuing to refer to FIGS. 3 and 4, inner housing 50 further has a number of stabilizing projections (four elongated evenly spaced stabilizing projections 66 are shown in FIGS. 3 and 4) extending outwardly from body portion 52, and a number of slots (two example slots 68 are shown in FIGS. 3 and 4) each defining a corresponding deflectable tab 72,74. Additionally, end 54 of inner housing 50 has another slot 76 defining another deflectable tab 78.

Figure 5:
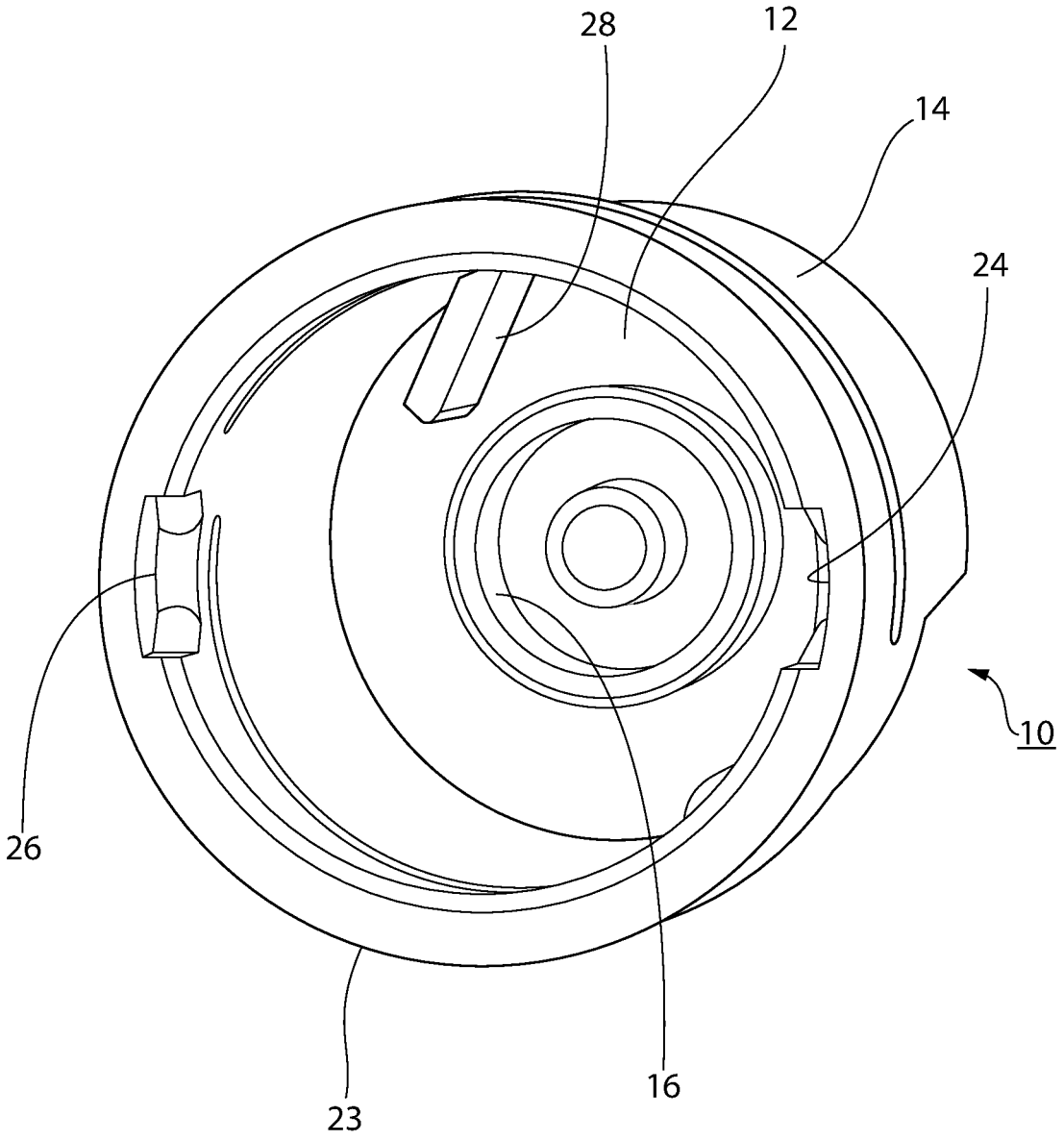
FIG. 5 is a bottom isometric view of an outer sleeve for the dispenser assembly of FIG. 2.

Referring to FIGS. 1, 2, and 5, outer sleeve 10 has an end 12, a first annular-shaped sidewall 14 extending from end 12, a second annular-shaped sidewall 16 (shown in FIG. 5) extending from end 12, and a deflection member 28 extending from first sidewall 14 and being located between first sidewall 14 and second sidewall 16. Although deflection member 28 is shown extending from first sidewall 14 and end 12, it is within the scope of the disclosed concept for a suitable alternative outer sleeve (not shown) to have a defection member that only extends from an end and not a first sidewall. Additionally, in one example embodiment, second sidewall 16 is located inboard of and is concentric with first sidewall 14. As shown in FIGS. 1 and 2, first sidewall 14 has a window 19 (i.e., a thru hole) located proximate end 12, a first number of grooves (two example grooves 20,22 are shown in FIGS. 1 and 2), and a second number of grooved regions (two example grooved regions 24,26 are shown in FIG. 5) each located internal with respect to and spaced from a cylindrical-shaped outer surface 23 of first sidewall 14. In one example embodiment, grooves 20,22 are helical-shaped.

The functionality of dispenser assembly 2 will now be discussed in greater detail. It will be appreciated that dispenser assembly 2 is structured to rotate between a first position (FIGS. 1 and 6-8) and a second position (FIGS. 9 and 12) in order to dispense solid units 4. In one example embodiment, the first position is a CLOSED position corresponding to window 19 being blocked by a portion of inner housing 50 such that solid units 4 cannot be dispensed through window 19, and the second position is an OPEN position corresponding to window 19 not being blocked by inner housing 50 in order to allow at least one of solid units 4 to be dispensed through window 19.

Figure 6:
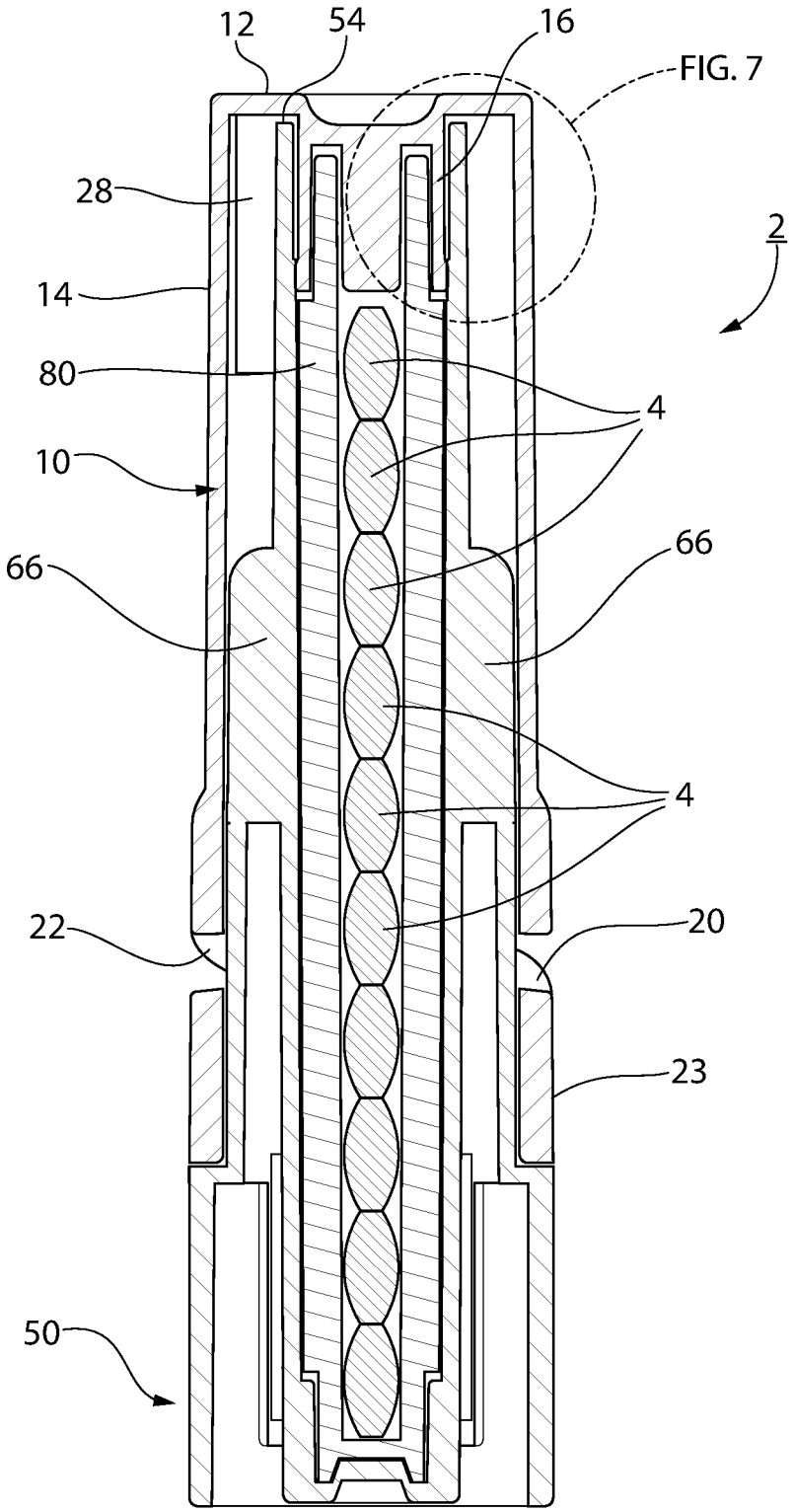
FIG. 6 is a section view of the dispenser assembly of FIG. 1.
Figure 7:
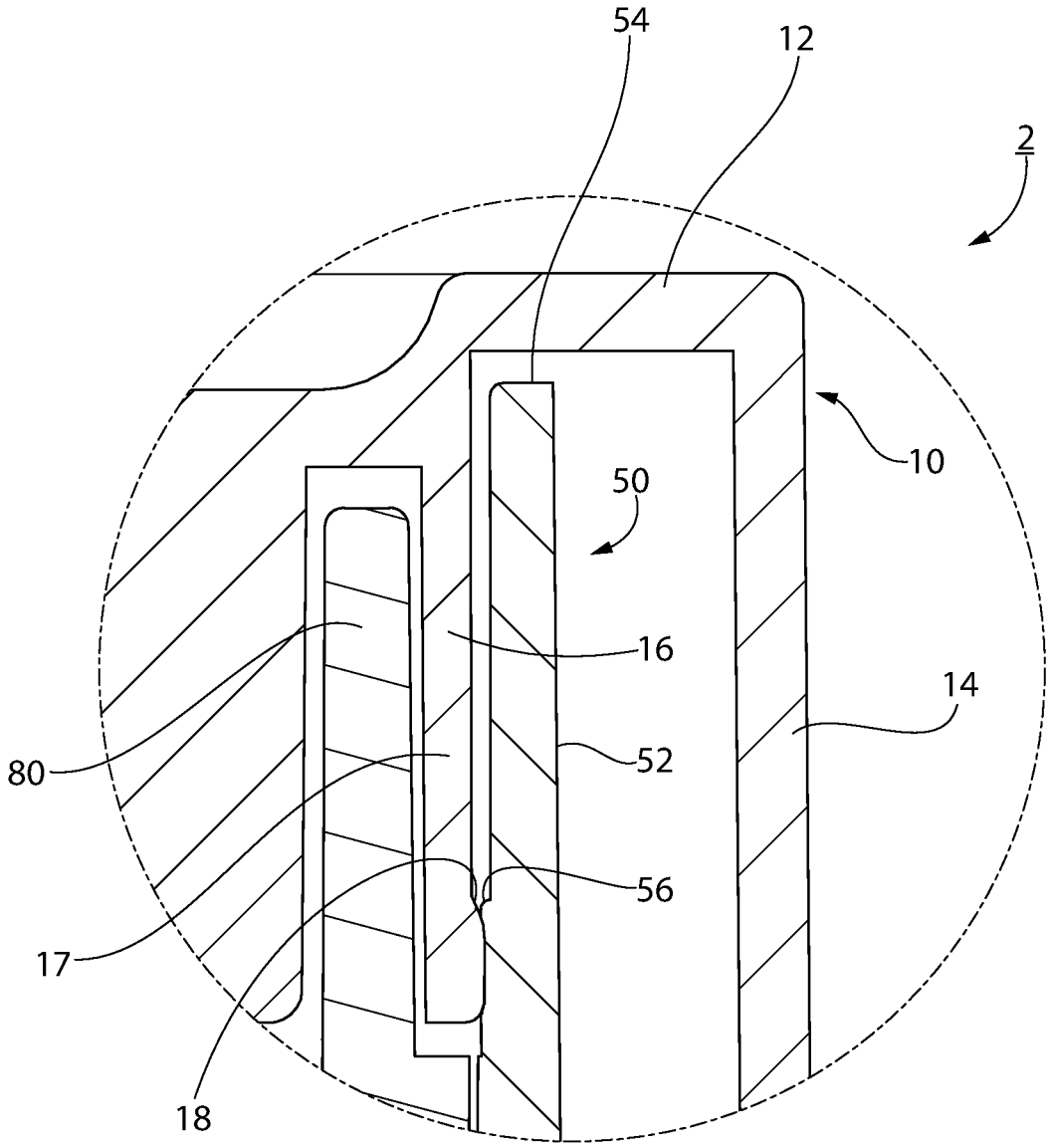
FIG. 7 is an enlarged view of a portion of the dispenser assembly of FIG. 6.

FIG. 6 shows a section view of dispenser assembly 2 in the first position, and FIG. 7 shows an enlarged view of a portion of FIG. 6. As shown, stabilizing projections 66 engage first sidewall 14 in order to stabilize inner housing 50 within outer sleeve 10. It will be appreciated that by employing multiple stabilizing projections 66, and by having them be evenly spaced from one another, inner housing 50 is advantageously able to be well maintained within outer sleeve 10 when dispenser assembly 2 rotates from the first position to the second position.

Referring to FIG. 7, second sidewall 16 includes a body portion 17 and a sleeve sealing surface 18 extending radially outwardly from body portion 17. It will be appreciated with reference to FIG. 6 that sleeve sealing surface 18 (FIG. 7) is located proximate to end 12 of outer sleeve 10. Furthermore, inner housing 50 has a housing sealing surface 56 extending radially inwardly from body portion 52. As shown in FIG. 7, when dispenser assembly 2 is in the first position, sleeve sealing surface 18 sealingly engages housing sealing surface 56 in order to form a moisture tight seal. "Moisture tight" in this context is defined as a sealed enclosure having a moisture ingress rate of less than 1000 micrograms per day, at 80% relative humidity and 22.2 degrees C. Moisture ingress may thus fall within one of several ranges. One such range is between 25 and 1000 micrograms per day. Another such range is 50-1000 micrograms per day. A further such range is 100-1000 micrograms per day. A seal is moisture tight when it substantially contributes to a sealed enclosure meeting the aforementioned moisture tightness criteria. Accordingly, in one exemplary embodiment, the first position is a SEALED position that provides moisture tightness to solid units 4, which are located within inner housing 50. It will thus be appreciated that sleeve sealing surface 18 and housing sealing surface 56 are biased toward engagement with each other when dispenser assembly 2 is in the first position.

In order to provide additional protection to moisture tight contents, e.g., solid units 4, inner housing 50 further includes an active agent such as, for example and without limitation, a desiccant entrained polymer portion 80. It will be appreciated that body portion 52 and desiccant entrained polymer portion 80 are preferably formed together as a single component (rather than separately assembled) by any suitable known manufacturing process (e.g., without limitation, overmolding, co-molding, two-shot injection molding). While the disclosed concept has been discussed thus far with dispenser assembly providing a sealed, moisture tight environment for solid units in the first position, it will be appreciated that alternative embodiments of the disclosed concept are contemplated wherein a moisture tight seal is not formed between the inner housing and the outer sleeve when the dispenser assembly is in the first position.

Figure 8:
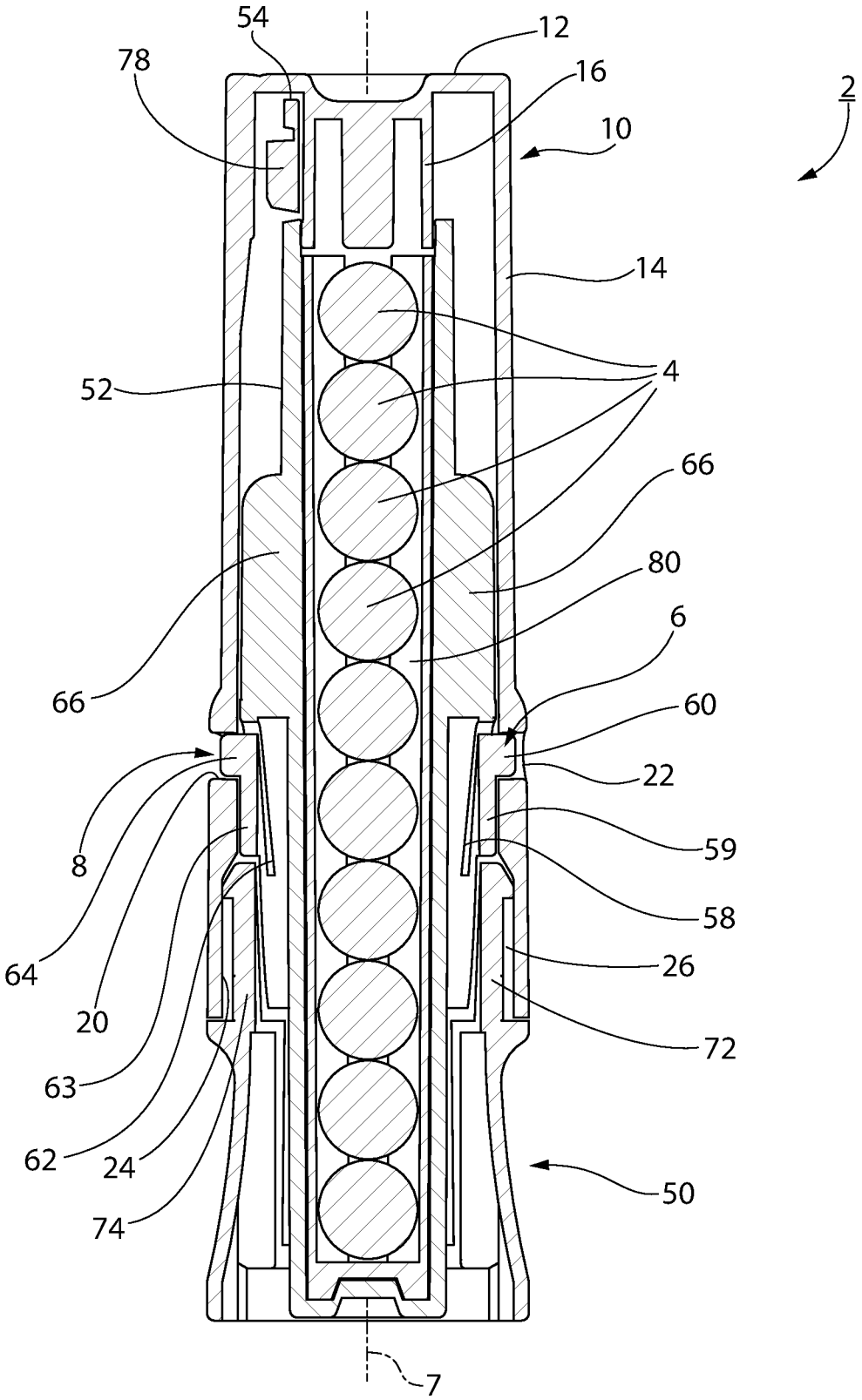
FIG. 8 is another section view of the dispenser assembly of FIG. 1.

FIG. 8 shows another section view of dispenser assembly 2 in the first position. As shown, button portions 60,64 of inner housing 50 are each located in one of grooves 20,22 of outer sleeve 10, and tabs 72,74 are each located in one of grooved regions 24,26 of outer sleeve 10. It will be appreciated that dispenser assembly 2 includes a number of cams 6,8 formed between button portions 60,64 and grooves 20,22. When dispenser assembly 2 rotates from the first position to the second position, cams 6,8 cooperate and engage with the preferably helical grooves 20,22, thus causing inner housing 50 to translate axially relative to outer sleeve 10. That is, cams 6,8 cause inner housing 50 to move along a longitudinal axis 7 with respect to outer sleeve 10.

In order to move dispenser assembly 2 from the first position to the second position, tabs 72,74 need to be deflected radially inwardly by a user. That is, when dispenser assembly 2 rotates from the first position (e.g., without limitation, the SEALED position) toward the second position (e.g., without limitation, a DISPENSING position), each corresponding tab 72,74 moves radially inwardly with respect to outer sleeve 10. As such, when dispenser assembly 2 is in the first position, tabs 72,74 lock or maintain inner housing 50 within outer sleeve 10 via the engagement with grooved regions 24,26. When a user squeezes each of tabs 72,74 radially inwardly toward each other, inner housing 50 is free to rotate with respect to outer sleeve 10, thereby allowing dispenser assembly 2 to rotate to the second position. Accordingly, when dispenser assembly 2 rotates between the first position (e.g., without limitation, the SEALED position) and the second position (e.g., without limitation, the DISPENSING position), button portions 60,64 rotate within grooves 20,22, and outer sleeve 10 translates axially with respect to inner housing 50.

Furthermore, it will be appreciated that assembly of dispenser assembly 2 is relatively simple. More specifically, as stated above, tabs 59,63 of inner housing 50 are deflectable. Accordingly, a user simply needs to deflect tabs 59,63 of inner housing 50 radially inwardly, and insert inner housing 50 into outer sleeve 10 until button portions 60,64 are received by, or pop-out within, one of grooves 20,22. At that time, inner housing 50 is free to rotate with respect to outer sleeve 10 by deflecting tabs 72,74 into and out of grooved regions 24,26, as discussed above.

Figure 9:
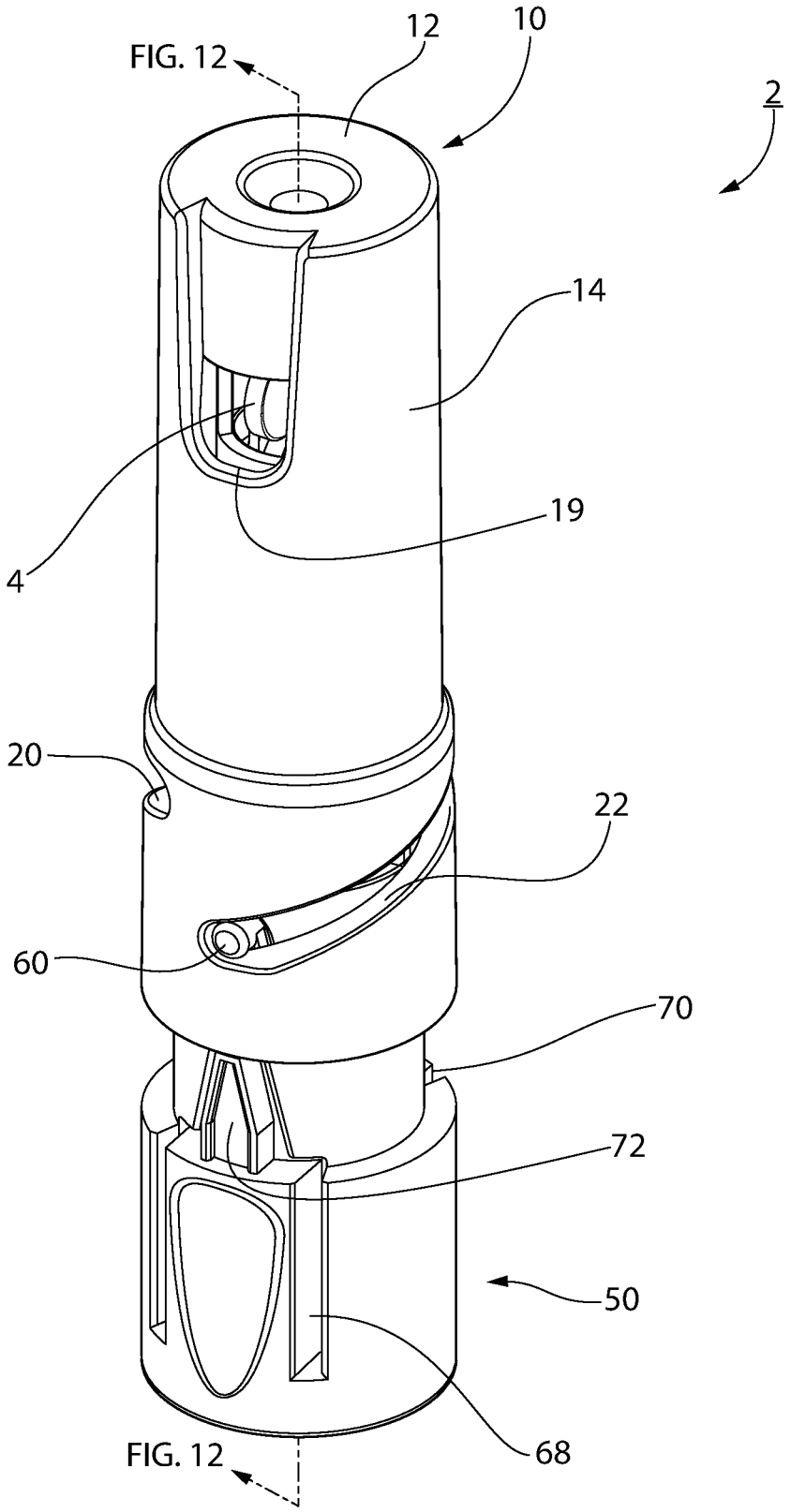
FIG. 9 is an isometric view of the dispenser assembly shown rotated to a second position.
Figure 10:
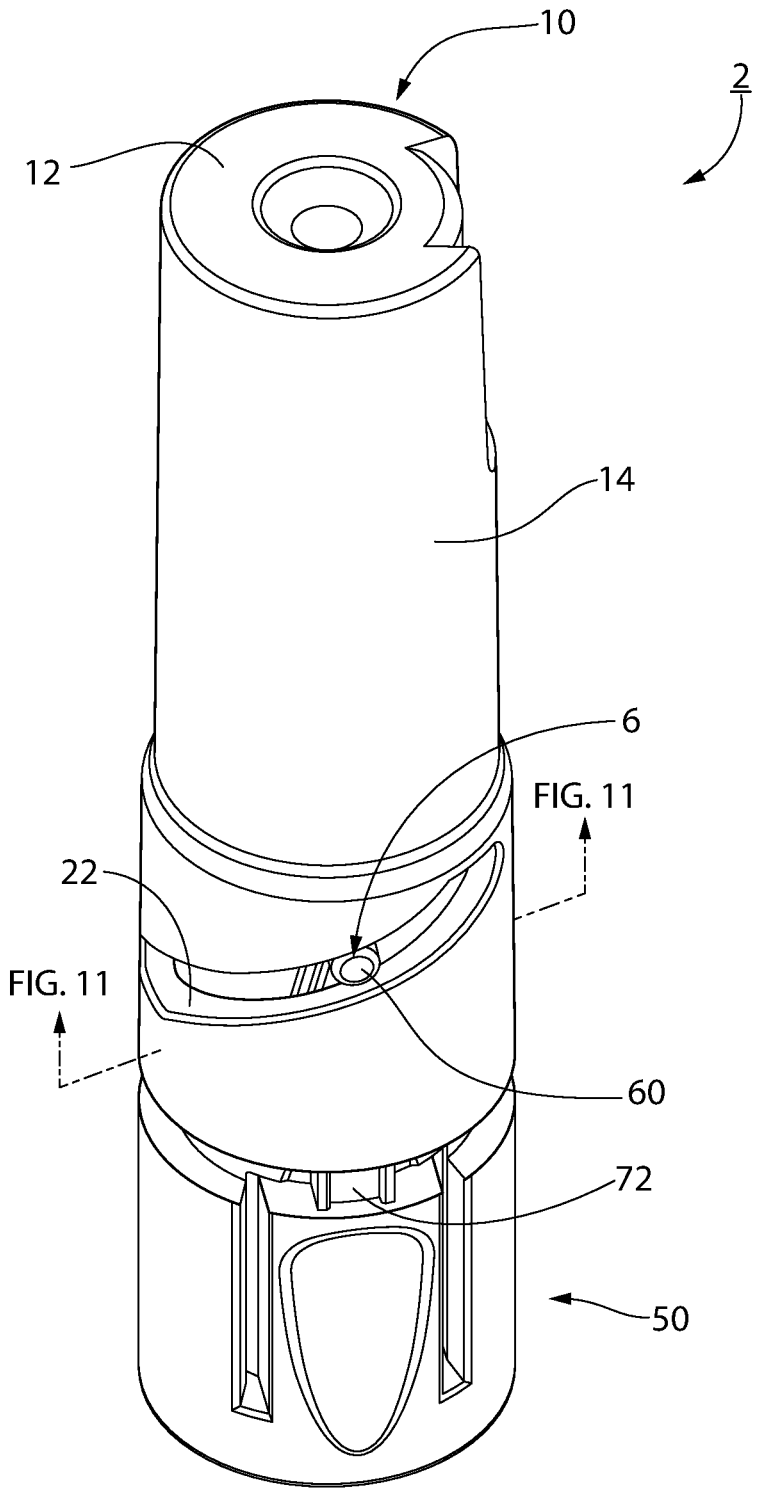
FIG. 10 is an isometric view of the dispenser assembly shown rotated to a third position between the first position and the second position.
Figure 11:
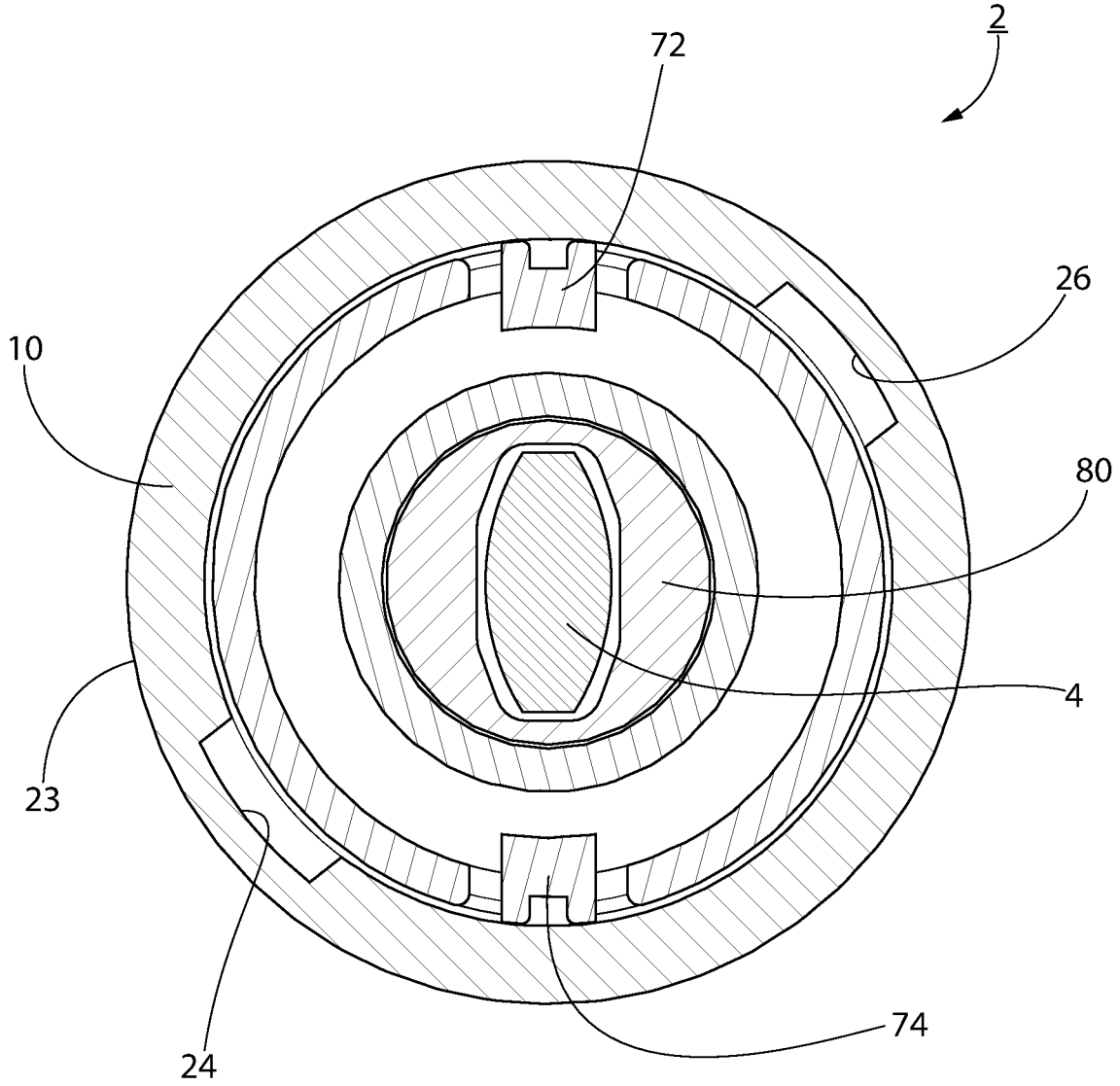
FIG. 11 is a section view of the dispenser assembly of FIG. 10.
Figure 12:
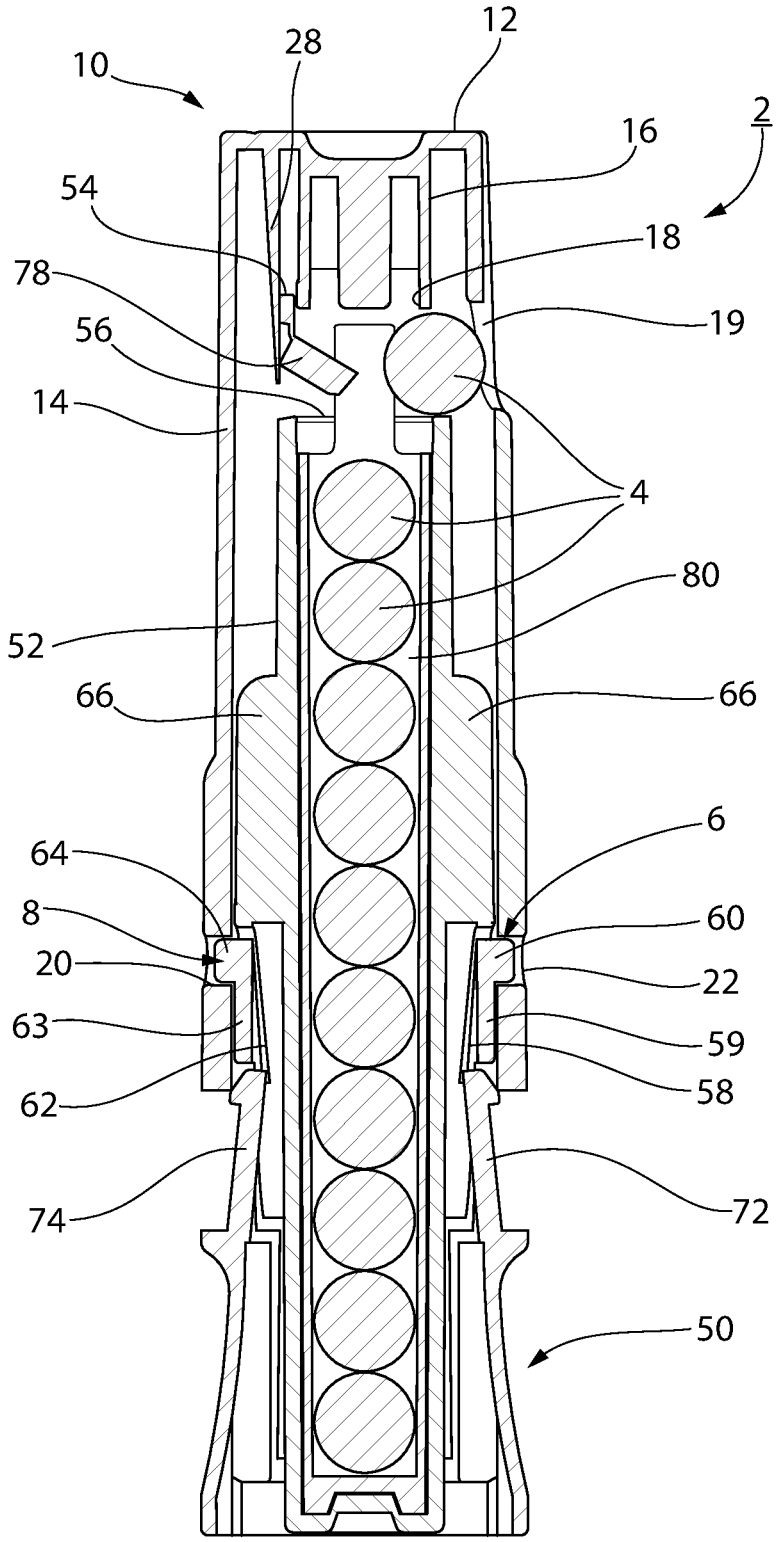
FIG. 12 is a section view of the dispenser assembly of FIG. 9.

FIGS. 9 and 12 show dispenser assembly 2 in the second position. FIGS. 10 and 11 show dispenser assembly 2 rotated to a third position between the first position and the second position. As shown in FIGS. 9 and 10, button portion 60 has moved (i.e., slid or rotated) within groove 22. As shown in FIG. 11, tabs 72,74 are no longer located within grooved regions 24,26. Furthermore, as shown in FIG. 12, one of solid units 4 is able to be dispensed through window 19.

More specifically, dispenser assembly 2 further has an ejection mechanism formed between inner housing 50 and outer sleeve 10. When dispenser assembly 2 rotates from the first position (e.g., without limitation, the SEALED position) toward the second position (e.g., without limitation, the DISPENSING position), the ejection mechanism ejects one of solid units 4 (see, for example, the top most solid unit 4 in FIG. 12) and maintains the other solid units 4 within inner housing 50. It will be appreciated that deflection member 28 of outer sleeve 10 and tab 78 of inner housing 50 form the ejection mechanism. Accordingly, when dispenser assembly 2 rotates from the first position (e.g., the SEALED position) toward the second position (e.g., the DISPENSING position), tab 78 is moved into engagement with deflection member 28, thereby allowing deflection member 28 to deflect tab 78 toward window 19 in order to eject one of solid units 4 from inner housing 50 and maintain the other of solid units 4 within the inner housing 50. That is, in one exemplary embodiment, the top most solid unit 4 is ejected by tab 78, and the other of solid units 4 are prevented from escaping inner housing 50 by tab 78, which blocks their exit path to window 19.

As discussed above, in one embodiment, when dispenser assembly 2 is in the first position, sleeve sealing surface 18 of outer sleeve 10 forms a moisture tight seal with housing sealing surface 56 of inner housing 50. Accordingly, as shown in FIG. 12, when dispenser assembly is rotated to the second position, sleeve sealing surface 18 is disengaged with housing sealing surface 56 in order to allow at least one of solid units 4 to be dispensed through window 19. As such, after a user has rotated dispenser assembly 2 to the second position to dispense one of solid units 4, the user can rotate dispenser assembly 2 back to the first position, re-forming the moisture tight seal between sleeve sealing surface 18 and housing sealing surface 56.

Figure 13:
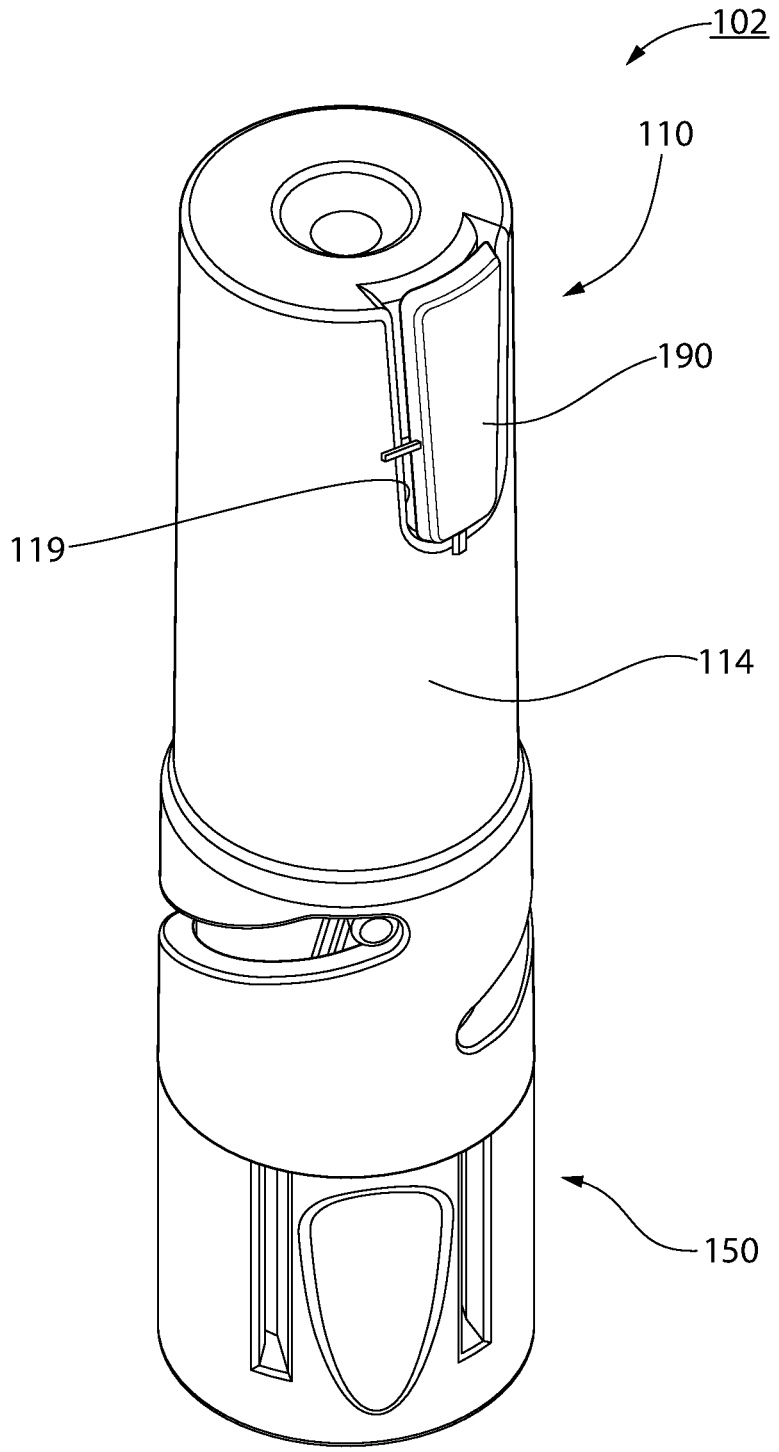
FIG. 13 is an isometric view of another dispenser assembly, in accordance with another non-limiting embodiment of the disclosed concept.

FIG. 13 shows an isometric view of another dispenser assembly 102, in accordance with another non-limiting embodiment of the disclosed concept. Dispenser assembly 102 includes an outer sleeve 110 and an inner housing 150 inserted into outer sleeve 110. Outer sleeve 110 and inner housing 150 cooperate with one another in the same manner as outer sleeve 10 and inner housing 50 of dispenser assembly 2, discussed above. That is, dispenser assembly 102 is structured to rotate between first and second positions in the same manner as dispenser assembly 2. However, different from dispenser assembly 2, outer sleeve 110 of dispenser assembly 102 further includes a blocking member 190 extending from a first sidewall 114 of outer sleeve 110. As shown, blocking member 190 substantially blocks and obstructs a window 119 formed in first sidewall 114. It will be appreciated that blocking member 190 is removably attached to (e.g., without limitation, is structured to be ripped off from) first sidewall 114 in order to provide a tamper-evident feature for dispenser assembly 102. More specifically, if blocking member 190 is attached to first sidewall 114, a user will know that none of the solid units (not shown in FIG. 13) within dispenser assembly 102 have been dispensed. Stated differently, if window 119 is blocked by blocking member 190, the user will know that none of the solid units could have escaped through window 119.

Although the disclosed concept has been described in association with dispenser assemblies 2,102 including only respective outer sleeves 10,110 and respective inner housings 50,150, it is within the scope of the disclosed concept for a suitable alternative dispenser assembly to have components in addition to or as an alternative to respective outer sleeves 10,110 and respective inner housings 50,150. Additionally, although the disclosed concept has been described in association with sleeve sealing surface 18 being located proximate to end 12 of outer sleeve 10, it is within the scope of the disclosed concept for a suitable alternative outer sleeve to have a sleeve sealing surface located at an end of the outer sleeve. It is also within the scope of the disclosed concept for a suitable alternative dispenser assembly to employ an O-ring (e.g., made from a thermoplastic elastomer) bonded at an outer sleeve in order to form a moisture tight seal with an inner housing when the dispenser assembly is in the first position.

The present disclosed concept has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosed concept that others can, by applying knowledge within the skill of the art, readily modify and/or adapt for various applications such specific embodiments, without undue experimentation, without departing from the general concept of the present disclosed concept. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present disclosed concept should not be limited by any of the above-described exemplary embodiments, but should be defined only in accordance with the following claims and their equivalents.

What is claimed:

1. A dispenser assembly for solid units, the dispenser assembly comprising:

an outer sleeve comprising an end, a first sidewall extending from the end of the outer sleeve, and a second sidewall extending from the end of the outer sleeve, the first sidewall having a window proximate to the end of the outer sleeve, the second sidewall being disposed inboard of the first sidewall; and an inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the second sidewall forming a moisture tight seal with the housing sealing surface, and a DISPENSING position corresponding to the second sidewall being disengaged with the housing sealing surface in order to allow at least one of the solid units to be dispensed through the window, and wherein the inner housing further comprises a body portion and at least one button portion extending outwardly from the body portion; wherein the first sidewall of the outer sleeve has at least one groove; and wherein, when the outer sleeve rotates relative to the inner housing between the SEALED position and the DISPENSING position, the at least one button portion rotates within the at least one groove.

2. The dispenser assembly according to claim 1, wherein the dispenser assembly further comprises a cam formed between the outer sleeve and the inner housing; and wherein, when the outer sleeve rotates relative to the inner housing between the SEALED position and the DISPENSING position, the cam causes the inner housing to translate axially relative to the outer sleeve.

3. The dispenser assembly according to claim 1, wherein the inner housing comprises a desiccant entrained polymer portion.

4. The dispenser assembly according to claim 1, wherein the at least one button portion comprises a first button portion and a second button portion disposed opposite and distal the first button portion; wherein the at least one groove comprises a first groove and a second groove disposed opposite the first groove; and wherein, when the outer sleeve rotates relative to the inner housing between the SEALED position and the DISPENSING position, the first button portion rotates within the first groove and the second button portion rotates within the second groove.

5. The dispenser assembly according to claim 1, wherein the body portion of the inner housing has at least one slot defining a tab, and wherein the at least one button portion extends outwardly from the tab.

6. The dispenser assembly according to claim 1, wherein the at least one groove is helical-shaped.

7. A dispenser assembly for solid units, the dispenser assembly comprising:

an outer sleeve comprising an end, a first sidewall extending from the end of the outer sleeve, and a second sidewall extending from the end of the outer sleeve, the first sidewall having a window proximate to the end of the outer sleeve, the second sidewall being disposed inboard of the first sidewall; and an inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the second sidewall forming a moisture tight seal with the housing sealing surface, and a DISPENSING position corresponding to the second sidewall being disengaged with the housing sealing surface in order to allow at least one of the solid units to be dispensed through the window, and wherein the dispenser assembly further comprises an ejection mechanism formed between the inner housing and the outer sleeve; and wherein, when the outer sleeve rotates relative to the inner housing from the SEALED position toward the DISPENSING position, the ejection mechanism ejects one of the solid units from the inner housing and maintains the other of the solid units within the inner housing, wherein the end of the inner housing has a slot defining a tab; wherein the outer sleeve further comprises a deflection member extending from the first sidewall; wherein the tab and the deflection member form the ejection mechanism; wherein the deflection member is disposed between the first sidewall and the second sidewall; and wherein, when the outer sleeve rotates relative to the inner housing from the SEALED position toward the DISPENSING position, the deflection member deflects the tab toward the window in order to eject the one of the solid units from the inner housing and maintain the other of the solid units within the inner housing.

8. The dispenser assembly according to claim 7, wherein the second sidewall comprises a body portion and a sleeve sealing surface extending radially outwardly from the body portion of the second sidewall; and wherein the sleeve sealing surface sealingly engages the housing sealing surface when the outer sleeve is in the SEALED position.

9. A dispenser assembly for solid units, the dispenser assembly comprising:

an outer sleeve comprising an end, a first sidewall extending from the end of the outer sleeve, and a second sidewall extending from the end of the outer sleeve, the first sidewall having a window proximate to the end of the outer sleeve, the second sidewall being disposed inboard of the first sidewall; and an inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the second sidewall forming a moisture tight seal with the housing sealing surface, and a DISPENSING position corresponding to the second sidewall being disengaged with the housing sealing surface in order to allow at least one of the solid units to be dispensed through the window, and wherein the inner housing further comprises a body portion having a number of slots each defining a tab; wherein the first sidewall of the outer sleeve has a number of grooved regions; and wherein, when the outer sleeve is in the SEALED position, each corresponding tab is disposed in a corresponding one of the grooved regions, wherein, when the outer sleeve rotates relative to the inner housing from the SEALED position toward the DISPENSING position, each corresponding tab moves radially inwardly with respect to the outer sleeve.

10. The dispenser assembly according to claim 9, wherein the inner housing further comprises a number of stabilizing projections extending outwardly from the body portion; and wherein the number of stabilizing projections are structured to engage the first sidewall of the outer sleeve in order to stabilize the inner housing within the outer sleeve.

11. The dispenser assembly according to claim 9, wherein the housing sealing surface extends radially inwardly from the body portion of the inner housing.

12. A dispenser assembly for solid units, the dispenser assembly consisting of an outer sleeve and an inner sleeve:

the outer sleeve comprising an end, a first sidewall extending from the end of the outer sleeve, and a sleeve sealing surface disposed at or proximate to the end of the outer sleeve, the first sidewall having a window proximate to the end of the outer sleeve; and the inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the sleeve sealing surface forming a moisture tight seal with the housing sealing surface, and a DISPENSING position corresponding to the sleeve sealing surface being disengaged with the housing sealing surface in order to allow at least one of the solid units to be dispensed through the window, wherein the dispenser assembly further comprises a cam formed between the outer sleeve and the inner housing; and wherein, when the outer sleeve rotates relative to the inner housing between the SEALED position and the DISPENSING position, the cam causes the inner housing to translate axially relative to the outer sleeve, and wherein the inner housing further comprises a body portion and at least one button portion extending outwardly from the body portion; wherein the first sidewall of the outer sleeve has at least one groove; wherein the at least one button portion and the at least one groove form the cam; and wherein, when the outer sleeve rotates relative to the inner housing between the SEALED position and the DISPENSING position, the at least one button portion rotates within the at least one groove.

13. The dispenser assembly according to claim 12, wherein the inner housing comprises a desiccant entrained polymer portion.

14. A dispenser assembly for solid units, the dispenser assembly comprising:

an outer sleeve comprising an end, a first sidewall extending from the end of the outer sleeve, and a sleeve sealing surface disposed at or proximate to the end of the outer sleeve, the first sidewall having a window proximate to the end of the outer sleeve; and an inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the sleeve sealing surface forming a moisture tight seal with the housing sealing surface, and a DISPENSING position corresponding to the sleeve sealing surface being disengaged with the housing sealing surface in order to allow at least one of the solid units to be dispensed through the window, wherein the inner housing further comprises a body portion having a number of slots each defining a tab; wherein the first sidewall of the outer sleeve has a number of grooved regions; and wherein, when the outer sleeve is in the SEALED position, each corresponding tab is disposed in a corresponding one of the grooved regions, wherein, when the outer sleeve rotates relative to the inner housing from the SEALED position toward the DISPENSING position, each corresponding tab moves radially inwardly with respect to the outer sleeve.

15. A dispenser assembly for solid units, the dispenser assembly consisting of an outer sleeve and an inner sleeve:

the outer sleeve comprising an end, a first sidewall extending from the end of the outer sleeve, and a sleeve sealing surface disposed at or proximate to the end of the outer sleeve, the first sidewall having a window proximate to the end of the outer sleeve; and the inner housing inserted into the outer sleeve, the inner housing comprising an end with an opening therein leading to a compartment configured for storing the solid units, the inner housing further having a housing sealing surface, wherein the outer sleeve is configured to rotate relative to the inner housing between a SEALED position corresponding to the sleeve sealing surface forming a moisture tight seal with the housing sealing surface, and a DISPENSING position corresponding to the sleeve sealing surface being disengaged with the housing sealing surface in order to allow at least one of the solid units to be dispensed through the window, and wherein the dispenser assembly further comprises an ejection mechanism formed between the inner housing and the outer sleeve; and wherein, when the outer sleeve rotates relative to the inner housing from the SEALED position toward the DISPENSING position, the ejection mechanism ejects one of the solid units from the inner housing and maintains the other of the solid units within the inner housing, wherein the end of the inner housing has a slot defining a tab; wherein the outer sleeve further comprises a deflection member extending from the first sidewall and being disposed internal with respect thereto; wherein the tab and the deflection member form the ejection mechanism; and wherein, when the outer sleeve rotates relative to the inner housing from the SEALED position toward the DISPENSING position, the deflection member deflects the tab toward the window in order to eject the one of the solid units from the inner housing and maintain the other of the solid units within the inner housing.

16. A dispenser assembly for solid units, the dispenser assembly comprising:

an outer sleeve comprising an end and a first sidewall extending from the end of the outer sleeve, the first sidewall having a window proximate to the end of the outer sleeve;

and an inner housing inserted into the outer sleeve, the inner housing comprising an end with an opening therein leading to a compartment configured for storing the solid units, wherein the outer sleeve is configured to rotate relative to the inner housing between a CLOSED position corresponding to the window being blocked by a portion of the inner housing, and an OPEN position corresponding to the window not being blocked by the inner housing in order to allow at least one of the solid units to be dispensed through the window, and wherein the inner housing further comprises a body portion and at least one button portion extending outwardly from the body portion; wherein the first sidewall of the outer sleeve has at least one groove; and wherein, when the outer sleeve rotates relative to the inner housing between the CLOSED position and the OPEN position, the at least one button portion rotates within the at least one groove.

17. The dispenser assembly according to claim 16, wherein the dispenser assembly further comprises a cam formed between the outer sleeve and the inner housing; and wherein, when the outer sleeve rotates relative to the inner housing between the CLOSED position and the OPEN position, the cam causes the inner housing to translate axially relative to the outer sleeve.

* * * * *